US009689139B2

(12) United States Patent
Friedrich

(10) Patent No.: US 9,689,139 B2
(45) Date of Patent: Jun. 27, 2017

(54) QUICK COUPLER

(71) Applicant: Kinshofer GmbH, Waakirchen (DE)

(72) Inventor: Thomas Friedrich, Schliersee (DE)

(73) Assignee: KINSHOFER GmbH, Waakirchen (DE)

( * ) Notice: Subject to any disclaimer, the term of this patent is extended or adjusted under 35 U.S.C. 154(b) by 287 days.

(21) Appl. No.: 14/615,520

(22) Filed: Feb. 6, 2015

(65) Prior Publication Data

US 2015/0225920 A1 Aug. 13, 2015

(30) Foreign Application Priority Data

Feb. 13, 2014 (DE) ..... 20 2014 001 328

(51) Int. Cl.
*E02F 3/36* (2006.01)

(52) U.S. Cl.
CPC ..... *E02F 3/3663* (2013.01); *E02F 3/365* (2013.01); *E02F 3/3618* (2013.01); *E02F 3/3622* (2013.01); *E02F 3/3627* (2013.01); *Y10T 403/22* (2015.01)

(58) Field of Classification Search
CPC ..... E02F 3/3622; E02F 3/3645; E02F 3/3663; E02F 3/365; E02F 3/3618; E02F 9/2225; E02F 9/2296; E02F 3/3627; Y10T 403/22
USPC ..... 37/403–410, 468; 172/272–274; 414/723
See application file for complete search history.

(56) References Cited

U.S. PATENT DOCUMENTS 6,260,357 B1 7/2001 Goodfellow et al.
7,828,070 B2 * 11/2010 Calvert ..... E02F 3/3622 172/272

(Continued)

FOREIGN PATENT DOCUMENTS

DE 202012009838 U1 10/2013
EP 1852555 A2 11/2007

(Continued)

OTHER PUBLICATIONS

German Search Report for Priority German Utility Model Application No. 20 2014 001 328.4 mailed Sep. 10, 2014.

(Continued)

*Primary Examiner* — Robert Pezzuto
(74) *Attorney, Agent, or Firm* — Troutman Sanders, LLP; Ryan A. Schneider

(57) ABSTRACT

A quick coupler for coupling a tool like for example a scoop, shell grab or demolition tongs to a tool guide such as an excavator arm or the like, including a coupling receptacle for receiving a first locking part and a locking receptacle for receiving a second locking part, wherein to the coupling receptacle a securing element is associated for catching and/or securing the first locking part in the coupling receptacle, and to the locking receptacle a locking element is associated for locking the second locking part in the locking receptacle, wherein the locking element and the securing element are actuable via a common pressure circuit having an unlocking pressure port and a locking pressure port selectively connectable with a pressure source or a return line via a valve. The securing element is actuable by a double-acting, reversible actuator and is movable both into an opening and a closing position.

30 Claims, 4 Drawing Sheets

(56) References Cited

U.S. PATENT DOCUMENTS

| | | | | |
|---|---|---|---|---|
| 2009/0282712 | A1* | 11/2009 | Pruszynski | E02F 3/3618 37/468 |
| 2010/0061799 | A1* | 3/2010 | Hill | E02F 3/3645 403/322.3 |
| 2013/0008153 | A1 | 1/2013 | Stefek et al. | |

FOREIGN PATENT DOCUMENTS

| | | | |
|---|---|---|---|
| EP | 2161378 | A1 | 3/2010 |
| GB | 2474573 | A | 4/2011 |
| GB | 2482515 | A | 2/2012 |

OTHER PUBLICATIONS

Search Report in related GB Application No. GB1501910.2, mailed Jun. 19, 2015.

* cited by examiner

QUICK COUPLER

CROSS-REFERENCE TO RELATED APPLICATIONS

This application claims the benefit of German Utility Model Application No. 20 2014 001 328.4 filed Feb. 13, 2014, the entire contents and substance of which is hereby incorporated by reference.

BACKGROUND OF THE INVENTION

1. Field of Invention

The present invention relates to a quick coupler for coupling a tool like for example a scoop, shell grab or demolition tongs to a tool guide such as an excavator arm or the like, comprising a coupling receptacle for receiving a first locking part and a locking receptacle for receiving a second locking part, wherein to the coupling receptacle a securing element is associated for catching and/or securing the first locking part in the coupling receptacle and to the locking receptacle a locking element is associated for locking the second locking part in the locking receptacle, wherein the locking element and the securing element are actuable via a common pressure circuit having an unlocking pressure port and a locking pressure port selectively connectable with a pressure source or a return line via a valve means.

2. Background and Related Art

On construction machines such as hydraulic excavators or joint grabs such as wood handling machines or demolition equipment or similar material handling machines there are frequently used quick couplers for coupling various tools such as buckets, shell grabs or demolition tongs to an excavator arm or similar tool guides such as articulated arm booms, in order to be able to use various tools without long retooling times. As locking elements, such quick couplers in particular can include two spaced locking axles on one coupling part, whereas the other coupling part, in particular the excavator-arm-side coupling part, can include a preferably hook-shaped coupling receptacle for hooking into a first one of the two locking axles and a locking receptacle for locking at the second locking axle. After hooking the first locking axle into the coupling receptacle, the two coupling parts can be pivoted relative to each other, wherein the locking axle sitting in the coupling receptacle forms the axis of rotation, so that the second locking axle moves into the locking receptacle and/or is swiveled into the same, where the second locking axle then can be locked by a locking element such as for example an extendable wedge, so that at the same time it is no longer possible either to move the first locking axle out of the coupling receptacle. The locking axles on the one coupling part can be formed by locking bolts which on the corresponding coupling part can extend in particular parallel to each other, wherein instead of such bolts, however, other structural parts of the coupling part such as protruding noses, knuckles, engagement stubs in the form of protrusions or recesses for example in the form of pockets also can serve as locking part, which are adapted to the shape of the coupling receptacle or the locking receptacle of the other coupling part.

To prevent the first locking axle from again being released from the coupling receptacle during the swiveling operating after hooking the first locking axle into the coupling receptacle, it has been proposed already to associate a securing element for example in the form of a spring-tensioned snap-in wedge to the coupling receptacle, which on hooking the locking axle into the coupling receptacle catches the locking axle and secures the same in the coupling receptacle. When the locking axle moves into the coupling receptacle, the safety catch is pushed back, until the position completely hooked in is reached, so that the safety catch can again snap back and block the path of movement out of the coupling receptacle. To be able to also move the first locking axle out of the coupling receptacle and/or unhook the same when demounting a tool after unlocking the locking receptacle, this securing element must again be released and/or be moved into its clearing position. This can be effected with actuation by a pressure medium, for example by a single-acting pressure medium cylinder, which is able to move the securing element against its spring bias into the locking and/or blocking position and back into the clearing position. Climbing down of the machine operator and/or a manual operation thereby can be avoided.

To make the actual locking mechanism, which in operation is transmitting power and by which the second locking element for example in the form of a locking axle is fixed and/or locked in the locking receptacle, independent of the actuation of the securing element associated to the coupling receptacle, clearing and/or releasing the securing element at the coupling receptacle is usually accomplished by a separate pressure medium circuit, which is controllable independently of the pressure medium circuit for actuating the locking mechanism and/or is formed separate there from. This decoupling is performed to prevent that disturbances at the securing element can pass over to the actual locking mechanism and during operation can affect an unwanted release of the coupler lock. Such disturbances for example might be pressure losses at sealing elements, for example, which are provided in pressure circuit portions leading to the securing element of the coupling receptacle. Such quick coupler with separate pressure circuits decoupled from each other for actuating the locking mechanism and for unlocking the securing element at the coupling receptacle are shown for example in the document EP 1852555 A2.

Since in practice in the past frequently sold quick couplers of the type, which still are in use, have not been provided with such additional securing element at the coupling receptacle, it would be desirable to not only provide such additional lock at the coupling receptacle of new appliances, i.e. new quick couplers, but also to be able to retrofit the same at old quick couplers. The solution shown in the document EP 1852555 A2 is also suitable in principle for retrofitting already existing quick couplers, but due to the separate pressure circuit for actuating the securing element of the coupling receptacle it requires three hydraulic ports, namely two ports for actuating the actual locking mechanism and a further pressure port for unlocking the securing element of the coupling receptacle. However, only two hydraulic pressure ports frequently are present on existing appliances, so that retrofitting with such additional lock at the coupling receptacle often is not possible.

In order to provide for an easy-to-actuate additional lock with only one pressure medium circuit and a limited number of pressure medium ports, DE 20 2012 007 124 suggests to connect the additional securing element to the pressure circuit via a pressure switching valve which pressure circuit has in principle been provided for actuating the main locking element. The pressure circuit thereby can be raised to a higher pressure level by avoiding and/or bypassing a pressure reducing valve, at which higher pressure level the pressure switching valve opens so that the additional lock can be released in the direction opposite to its spring pre-load.

Such connection of the additional lock to the pressure circuit of the main lock has so far, however, been unsatisfactory in so far as locking of the additional lock is effected only by means of spring pre-tension so that in the case of wear of the spring device it might occur that, upon opening of the additional lock, the adjust cylinder filled with hydraulic oil cannot be moved back safely and fast enough and the additional lock cannot be locked again. In addition, the hybrid construction method of actuators provided for so far, which provides for a hydraulic opening and a mechanical pretensioned closing of the additional lock, is relatively complex and intricate.

Proceeding there from, it is the object underlying the present invention to create an improved quick coupler of the type mentioned above, which avoids the disadvantages of the prior art and develops the latter in an advantageous way. In particular, there should be created an easily structured, permanently safely actuable additional lock at the coupling receptacle, which does not require an increased number of pressure medium ports.

BRIEF SUMMARY OF THE INVENTION

Briefly described, in a preferred form, the present invention comprises a coupling assembly comprising a first coupling member comprising a securing element and a double-acting, reversible actuator comprising a first chamber and a second chamber, the double-acting, reversible actuator having an opening position and a locking position, and a pressure circuit comprising pressure medium, an unlocking pressure port, a locking pressure port, a first valve arrangement, and a second valve arrangement, wherein the securing element is actuable by the double-acting, reversible actuator and is movable into the opening position and the locking position by the pressure medium of the pressure circuit, and wherein the first and second pressure chambers of the double-acting, reversible actuator are pressurizable via the first and second valve arrangements in dependency of a pressure level at one or both of the unlocking and locking pressure ports of the pressure circuit.

The coupling assembly can further comprise a second coupling member comprising a first locking part and a second locking part, wherein the first coupling member further comprises a coupling receptacle, a locking receptacle, and a locking element, wherein the coupling receptacle of the first coupling member dimensioned to receive the first locking part of the second coupling member, and wherein the securing element of the first coupling member dimensioned to catch and/or secure the first locking part in the coupling receptacle, wherein the locking receptacle of the first coupling member dimensioned to receive the second locking part of the second coupling member, and wherein the locking element of the first coupling member dimensioned to lock the second locking part in the locking receptacle, and wherein the securing element and the locking element of the first coupling member are actuatable by the pressure circuit.

The present invention can comprise a quick coupler for coupling a tool to an excavator arm or the like, comprising a coupling receptacle for receiving a first locking part and a locking receptacle for receiving a second locking part, wherein to the coupling receptacle a securing element is associated for catching and/or securing the first locking part in the coupling receptacle, and to the locking receptacle a locking element is associated for locking the second locking part in the locking receptacle, wherein the locking element and the securing element are actuatable by a common pressure circuit which includes an unlocking pressure port (and a locking pressure port, wherein the additional securing element is actuable by a double-acting, reversible actuator and is hydraulically movable into an opening position as well as into a locking position by means of applying pressure medium from the common pressure circuit, wherein different pressure chambers of the actuator are pressurizable via a valve arrangement in dependency of a pressure level at the unlocking and/or locking pressure port of the common pressure circuit.

Hence, it is proposed both to hydraulically open and to hydraulically close the securing element and to use pressure medium from the common pressure medium circuit for both movements. Pressure fluid provided at the unlocking and locking pressure ports of the common pressure circuit is thereby transmitted via a valve arrangement to different pressure chambers of a multiple-acting actuator actuable in different directions depending on the pressure level present in the common pressure circuit and/or at the unlocking and/or locking pressure port. The valve arrangement works in dependency of the pressure level at the unlocking and/or locking pressure port of the common pressure circuit and reverses the actuator in dependency of the pressure level.

According to the invention, the additional securing element is actuable by a double-acting, reversible actuator and is movable both into an opening and a closing position by means of applying pressure medium from the common pressure circuit, wherein various pressure chambers of the actuator are pressurizable via a valve arrangement in dependency of a pressure level at the unlocking and/or locking pressure port of the common pressure circuit.

Depending on the pressure level at the unlocking and/or locking pressure port, one pressure chamber or the other or a variable number of pressure chambers can thereby be pressurized such that at a first pressure level only one and at a second pressure level two or more pressure chambers or in general at a first pressure level fewer pressure chambers and at a second pressure level more pressure chambers are pressurized. In accordance with a development of the invention, pressurization of only a first pressure chamber can in particular be provided for at a first, preferably lower pressure level at the unlocking and/or locking pressure port while a second pressure chamber of the actuator is kept at least substantially pressure-free, whereas at a second, preferably higher pressure level both the aforesaid first and a further, second pressure chamber are pressurizable.

The first and second pressure chambers can in this context be acting in opposite directions so that pressure in the first pressure chamber attempts to move the actuator and thus the securing element into a first direction, while pressure in the second pressure chamber attempts to drive or urge the actuator and the securing element connected therewith into the opposite direction. In order to achieve, in the case of pressurization of both pressure chambers, not merely a pressure compensation of the pressures directed against each other, but to achieve an actuation of the actuator, the pressure in one chamber can be reduced vis-à-vis the pressure in the other chamber for example by means of a pressure reducing valve. In accordance with a development of the invention, however, also both chambers acting in opposite directions can be subjected to the same pressure or a substantially equal pressure. In order to still be able to achieve an actuation, the pressure chambers acting in opposite directions can have cross-sectional areas of different size, so that the pressure in the chamber having the greater cross-sectional area wins so to speak and drives or urges the actuator.

In this context, in particular a double-acting pressure cylinder can be provided for as actuator, which pressure cylinder has a first pressure chamber with a piston rod extending there through and a second pressure chamber acting in the opposite direction the cross-sectional area of which is larger than that of the aforementioned first pressure chamber. A defined actuation can thus be achieved in a simply manner even if the same pressure level is applied to both pressure chambers.

In accordance with an advantageous development of the invention, the aforementioned valve arrangement is in this context adapted such that one of the pressure chambers of the actuator is substantially permanently subjected to pressure from the common pressure circuit so as to provide for a permanent pressure fluid pre-load of the actuator in one direction. The valve arrangement can in particular be adapted such that pressure at the unlocking pressure port and/or pressure at the locking pressure port is connected through to the actuator and/or the first pressure chamber thereof. As soon as pressure is present at the unlocking pressure port, such pressure can be applied to the pressure chamber by the valve arrangement. As soon as, on the other hand, pressure is present at the locking pressure port, such pressure can be applied to the chamber of the actuator. If pressure is present at both pressure ports, the valve arrangement can be adapted such that the higher pressure is applied to the pressure chamber of the actuator.

In accordance with an advantageous development of the invention, the valve arrangement can comprise an alternating check valve and/or a so-called shuttle valve connected with both the locking pressure port and the unlocking pressure port, which valve interconnects the locking port and locks the unlocking port when pressure in the locking port is higher, whereas in the case of higher pressure in the unlocking pressure port the unlocking pressure port is interconnected and the locking port is locked. Locking of the respective other pressure port can prevent unwanted back flow and ensures that the pressure is applied to that pressure chamber of the actuator with which the alternating check valve and/or shuttle valve is connected. The alternating check valve and/or shuttle valve may be adapted to be a bidirectional check valve.

A second or further pressure chamber of the actuator can be connected with the unlocking pressure port and/or with the locking pressure port of the common pressure circuit via a pressure switch valve which pressure switch valve opens only at a predetermined pressure level and is thus, depending on the pressure level in the common pressure circuit, shut off from or connected to the pressurization thereof.

In particular, a permanent pressurization of that pressure chamber of the actuator that attempts to drive or urge the securing element into its locking position can be provided for in the above described manner via the alternating check valve. A hydraulic pre-load of the securing element into its locking position is hereby ensured. In the alternative or in addition, that pressure chamber of the actuator that attempts to drive or urge the securing element into its opening position, can be connected to the common pressure circuit in the above described manner by pressure control and can thus be pressurized or not be pressurized in dependency of the pressure level. It can hereby in particular be achieved that if a higher pressure level above a threshold pressure of the pressure switch valve is provided for, opening of the securing element is achieved.

In accordance with an advantageous development of the invention, that pressure chamber of the actuator that is responsible for the closing movement of the securing element, has a smaller effective cross-section and/or a smaller effective cross-sectional area than the pressure chamber that acts in the opposite direction and is responsible for opening the securing element.

In accordance with an advantageous development of the invention, the actuator is adapted to be free from mechanical spring devices or non-hydraulic pretensioning devices. Due to a purely hydraulic, non-hybrid embodiment of the actuator, an easy structure of the device can be achieved.

The pressure switching valve, which opens upon reaching/exceeding a predetermined first pressure, can be connected with the unlocking pressure port of the pressure circuit and the valve means of the pressure circuit can include a pressure control means for selectively controlling the pressure applied at the unlocking pressure port to a second pressure greater than the first pressure and to a third pressure lower than the first pressure. It can be achieved by the pressure switching valve that the unlocking chamber of the additional lock at the coupling receptacle only is connected to the pressure circuit for actuating the locking mechanism when the pressure circuit at the unlocking pressure port provides the increased second pressure, which lies above the switching pressure of the pressure switching valve. However, when the pressure circuit operates in its so to speak normal locking/unlocking mode for the locking element at the locking receptacle, and at the unlocking pressure port and preferably also at the locking pressure port provides a pressure level which lies below the switching pressure of the pressure switching valve, the additional lock at the coupling receptacle remains uninvolved and cut off by the pressure switching valve.

By connecting the additional lock of the coupling receptacle and the locking mechanism of the locking receptacle to the common pressure circuit in the above described manner, the quick coupler as a whole can do with only two pressure ports despite the bidirectional, fully hydraulic actuation of the additional lock at the coupling receptacle. Nevertheless, it is ensured by the provided actuation at different pressure levels that the additional lock at the coupling receptacle does not open unintentionally already before locking at the locking receptacle, or damages at the additional lock might lead to a malfunction of the locking mechanism in working operation.

In accordance with a development of the invention, the differently high pressure levels for actuating the securing element of the coupling receptacle on the one hand and the locking element of the locking receptacle on the other hand can be achieved by at least one pressure reducing valve, which selectively can be bypassed by an upstream directional and/or switching valve or can be connected into the flow path, so that a pressure reduced by the pressure reducing valve or a pressure not reduced by the pressure reducing valve selectively can be applied to the unlocking pressure port. As an alternative to such bridging or bypass solution with a switching valve it would likewise be possible to use a pressure reducing valve variable and/or controllable in terms of the pressure reduction, so that in this case a directional valve provided upstream of the pressure reducing valve possibly might be omitted. The bypass solution with an upstream directional valve, however, allows a reliable adjustment of two defined pressure levels sufficiently spaced from each other, by means of which a defined switching on or off of the securing element of the coupling receptacle can be achieved in conjunction with the aforementioned pressure switching valve. In particular, the aforementioned pressure control means can include a pressure reducing valve which reduces the second pressure, which lies above the switching pressure of the pressure switching valve and is provided for actuating the securing element of the coupling receptacle, to the third pressure which is lower than the switching pressure of the pressure switching valve and is provided for actuating the locking element of the locking receptacle. In a first switching position, the switching valve provided upstream of the pressure reducing valve can apply an input pressure, which can correspond to the second pressure and/or can be provided by a pressure source, to the pressure reducing valve, and in a second switching position can apply the input pressure past or bypassing the pressure reducing valve to the unlocking pressure port. "Upstream" here refers to the fact that the switching valve is arranged between a pressure source or a pressure source port and the pressure reducing valve, so that pressure coming from the pressure source and/or pressure fluid coming from the pressure source first flows through the switching valve, before the pressure reducing valve is reached.

These and other objects, features and advantages of the present invention will become more apparent upon reading the following specification in conjunction with the accompanying drawing figures.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
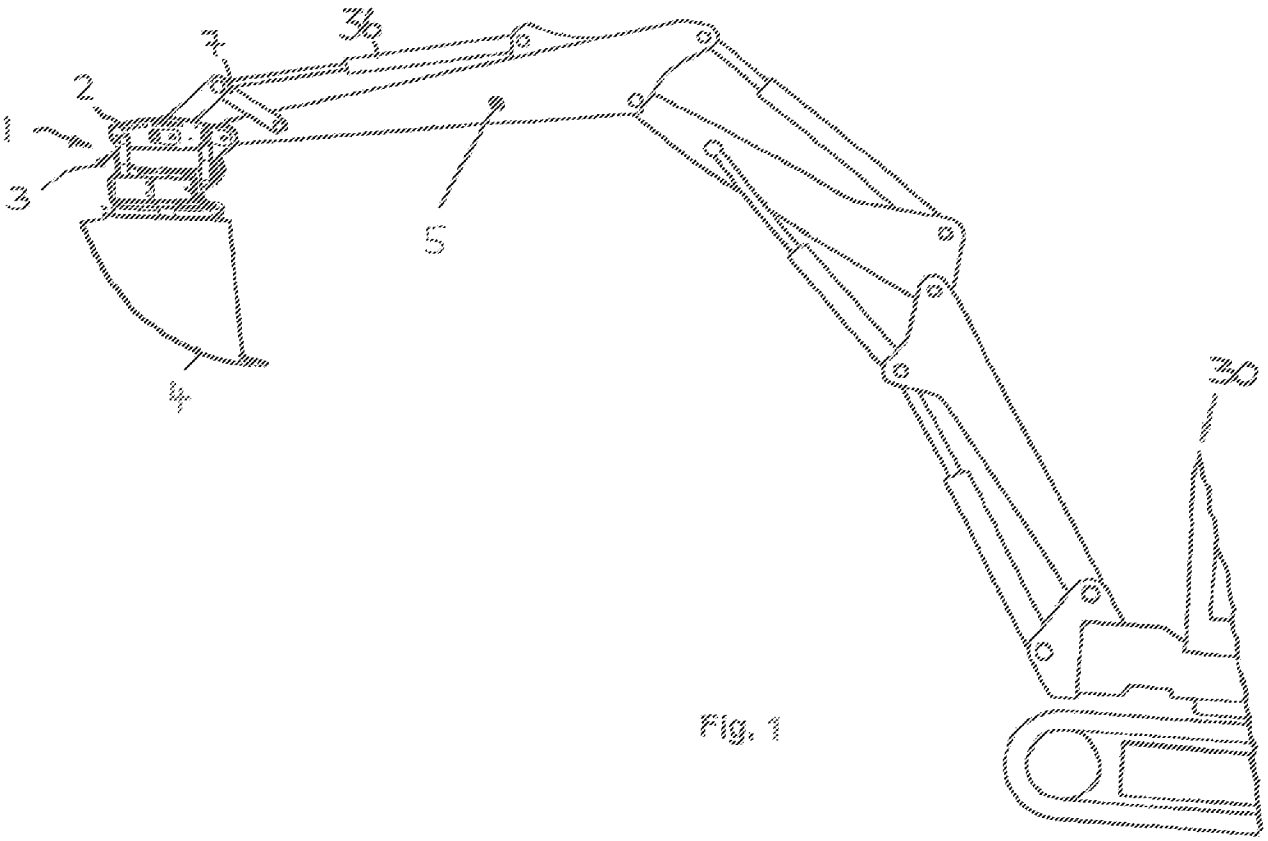
FIG. 1 shows a schematic side view of a quick coupler according to an advantageous embodiment of the invention, which is attached to a boom arm of an excavator and couples a bucket as attachment tool.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

As shown in FIG. 1, the quick coupler 1 can be mounted between the free end of the boom arm 5 of an excavator 30 and the tool 4 to be attached thereto, wherein in FIG. 1 the attachment tool 4 is formed as bucket, but in the usual manner can of course also comprise other corresponding construction, handling or demolition tools for example in the form of shell grabs, demolition tongs, shears or the like. By means of an arm-side coupler part 2, the quick coupler 1 on the one hand is pivotably mountable to the boom arm 5 about a horizontal swivel axis oriented transversely to the longitudinal axis of the boom arm 5, so that the quick coupler 1 together with the tool 4 attached thereto can be pivoted with respect to the boom arm 5 for example by means of a pressure medium cylinder 36 and an interposed pivot piece 7.

Figure 2:
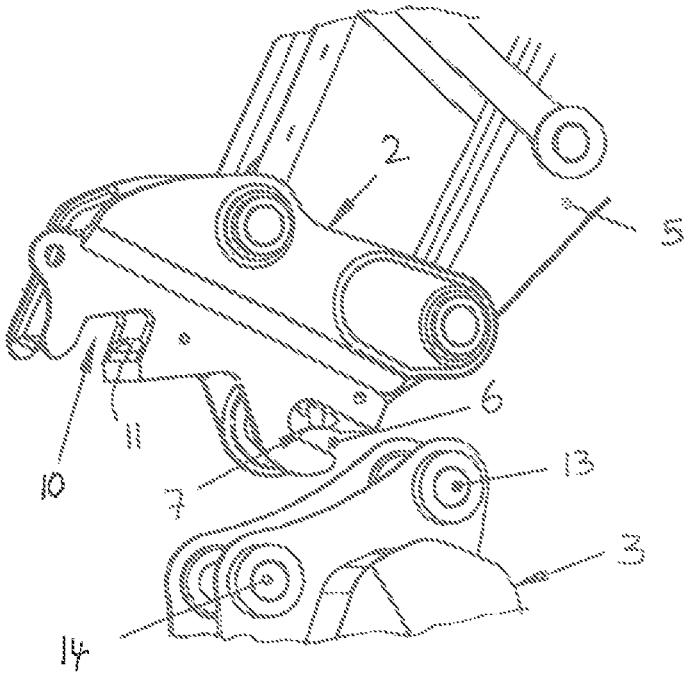
FIG. 2 shows a perspective representation of the quick coupler of FIG. 1 in a decoupled position in which the coupling parts to be coupled with each other are shown shortly before hooking in at the hook portion.

By means of a tool-side coupler part 3—cf. FIG. 2—the quick coupler on the other hand can be attached to the attachment tool 4 and/or an interposed slewing drive.

Figure 3:
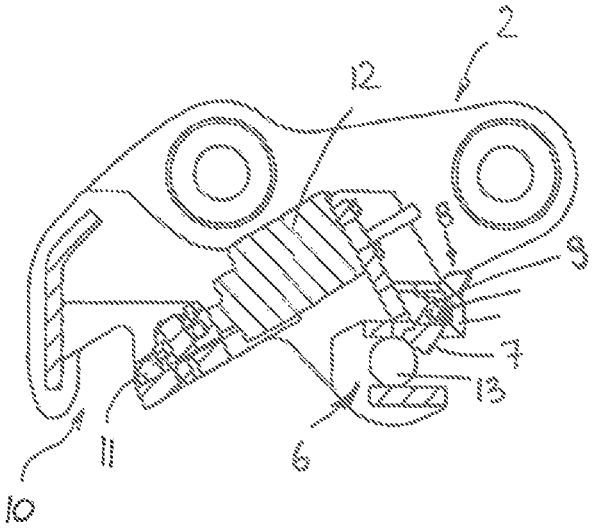
FIG. 3 shows a sectional view through the coupling part of the quick coupler of the present invention that shows the coupling receptacle and the locking receptacle as well as the associated securing and locking elements and their actuators.

As shown in FIGS. 2 and 3, one of the two coupler parts 2 and 3, preferably the arm-side coupler part 2 on the one hand can comprise a coupling receptacle 6 and on the other hand a locking receptacle 10, which can be hooked into or be brought in engagement with two locking parts, for example in the form of locking axles 13 and 14 at the other, preferably tool-side coupler part 3. Contrary to the representation of the drawing it would, however, also be conceivable in principle to provide a locking axle and a receptacle at one coupler part and in turn a locking axle and a receptacle at the other coupler part, wherein however the illustrated embodiment with two receptacles, i.e. locking receptacle and coupling receptacle at the one coupler part and two locking axles corresponding therewith at the other coupler part, is preferred, since the associated securing and locking elements and their actuation then can be combined at one coupler part.

As shown in FIG. 2, the coupling receptacle 6 and the locking receptacle 10 each form a jaw-like receptacle open towards one side, into which the locking axles 13 and 14 can move, which can be formed by transverse bolts or locking bolts, cf. FIG. 2. The coupling receptacle 6 and the locking receptacle 10 advantageously are arranged and configured such that when a first locking axle 13 of the one coupler part 3 is moved or hooked into the preferably hook-shaped coupling receptacle 6 of the other coupler part 2, the two coupler parts can be pivoted relative to each other, namely such that the coupling receptacle 6 or the locking axle 13 accommodated therein form the axis of rotation and due to the corresponding swivel movement the second locking axle 14 can move into the locking receptacle 10, so that the two coupler parts 2 and 3 can be coupled with each other in a two-stage coupling process. The coupling receptacle 6 first is hooked in at the first locking axle 13, whereupon the locking receptacle 10 can be brought in engagement with the second locking axle 14 by pivoting the two coupler parts 2 and 3 relative to each other—which can be effected for example by actuating the aforementioned slewing cylinder 36.

When the second locking axle 14 has been moved into the locking receptacle 10, the second locking axle 14 is locked in the locking receptacle 10 or the locking receptacle 10 is closed, so that the second locking axle 14 can no longer get out. For this purpose, a locking element 11 is provided for example in the form of a locking wedge, which on the opening side of the locking receptacle 10 can be moved before the locking axle 14 accommodated therein, cf. FIG. 3. For actuating the locking element 11, a hydraulically actuatable actuator 12 advantageously is provided, which is directly or indirectly connected with the locking element 11 and advantageously is of the double-acting type, so that it can be moved back and forth.

Locking the locking element 11 not only holds the second locking axle 14 in the locking receptacle 10, but the two coupler parts 2 and 3 also are locked with each other, since the coupling receptacle 6 is formed such that the first locking axle 13 accommodated therein cannot get out of the coupling receptacle 6, when the second locking axle 14 is caught in the locking receptacle 10.

Nevertheless, a securing element 7 is associated to the coupling receptacle 6, by means of which the first locking axle 13 or a suitable locking part can be caught or secured or blocked in the coupling receptacle 6, so that the first locking axle 13 cannot inadvertently slip out of the coupling receptacle 6. This securing element 7 chiefly serves to prevent the first locking axle 13 from inadvertently slipping out of the coupling receptacle 6 during the aforementioned swivel movement during the coupling operation, as long as the two coupler parts 2 and 3 are not yet locked with each other by closing the locking element 11.

Figure 4:
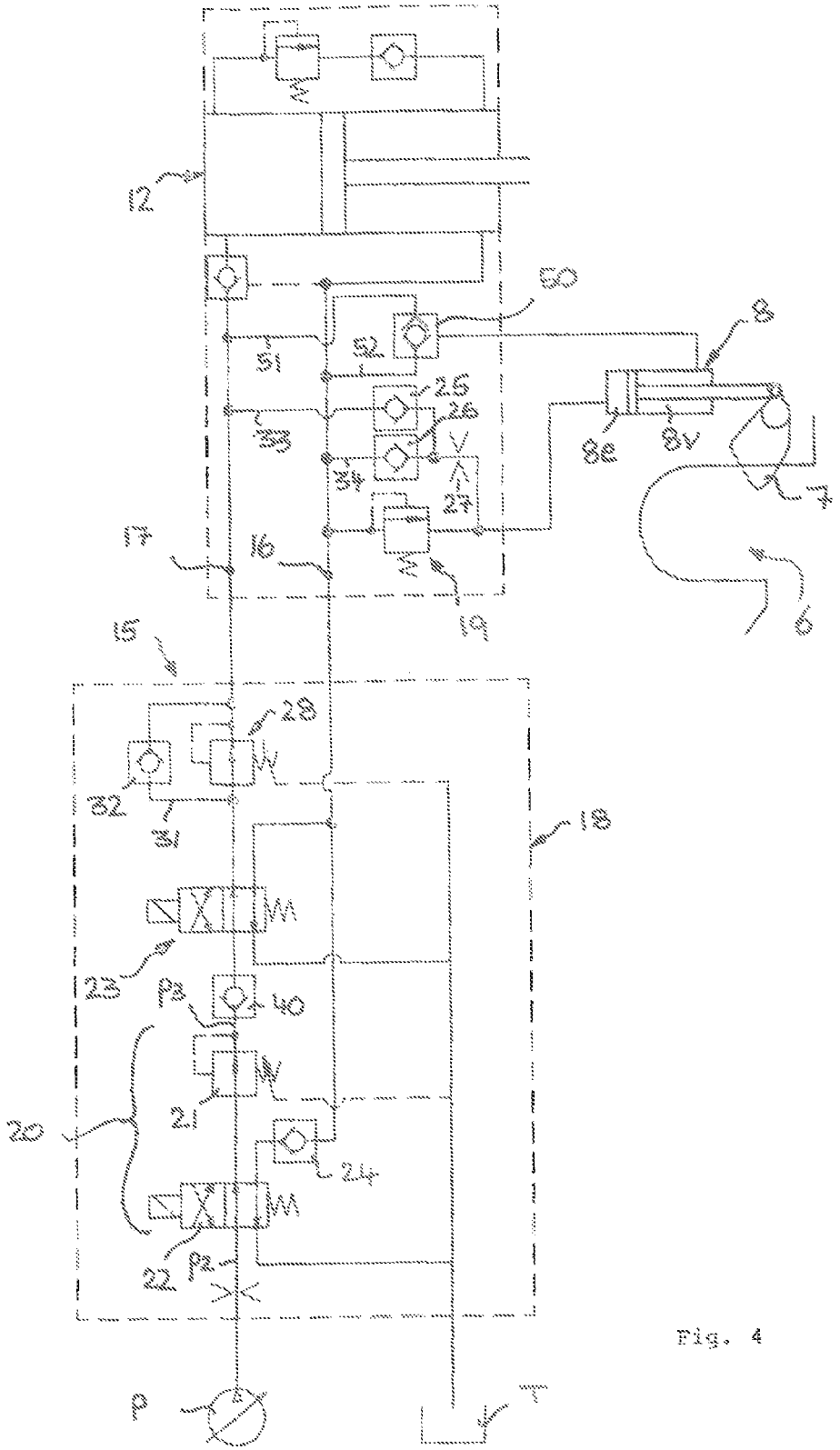
FIG. 4 shows a circuit diagram of the common pressure circuit for actuating the securing element associated to the coupling receptacle and the locking element associated to the locking receptacle.

The securing element 7 likewise can be a wedge-shaped slide or also, as shown in FIG. 3 or FIG. 4, a pivotally mounted locking lever which in its locking position tapers or blocks the opening of the coupling receptacle 6 to such an extent that the first locking axle 13 cannot slip out, cf. FIG. 3.

The securing element 7 is in this connection hydraulically biased into the locking position, but can, when the first locking axle 13 moves into the coupling receptacle 6, be pushed back advantageously automatically against the hydraulic pressure and/or upon switching off the hydraulic pressure. When the locking axle 13 has completely or sufficiently been moved into the coupling receptacle 6, the securing element 7 can move into the locking position driven or urged by the hydraulic pressure, so that the locking axle 13 is caught.

For locking and releasing the securing element 7 for the purpose of coupling and decoupling, an actuator 8 in the form of a double-acting or bidirectionally acting hydraulic cylinder is thereby associated to the securing element 7, by means of which the securing element 7 can be moved or pivoted into its clearing position and its locking position.

The actuation of the two securing and locking elements 7 and 11 by a common pressure circuit 15 is shown in FIG. 4. The pressure circuit 15 on the one hand is connected with a pressure source P for example in the form of a pump, by means of which the pressure circuit 15 is fed with pressure fluid, in particular hydraulic pressure, and on the other hand connected with a tank T into which pressure fluid can flow back. On the other hand, the pressure circuit 15 comprises two pressure ports, namely on the one hand a locking pressure port 17 and on the other hand an unlocking pressure port 16, with which the double-acting actuator 12 of the locking element 11 is connected, in order to be able to release and close the locking of the quick coupler 1, i.e. to be able to lock and unlock the second locking axle 14 in the locking receptacle 10. To be able to control this main locking operation or unlocking operation, the pressure circuit 15 comprises a valve means 18 by means of which the unlocking pressure port 16 or the locking pressure port 17 selectively can be connected with the pressure source P.

As shown in FIG. 4, the valve means 18 for this purpose comprises a primary switching valve 23 which in one switching position switches the pressure line coming from the pressure source P to the locking pressure port 17 and the unlocking pressure port 16 to the tank, and in another switching position inversely connects the line coming from the pressure source P with the unlocking pressure port 16 and the locking pressure port 17 with the tank. In the line leading to the locking pressure port 17 a pressure reducing valve 28 is provided, so that the pressure used for locking is lower than the pressure used for unlocking. As shown in FIG. 4, the pressure reducing valve 28 advantageously is provided with a bypass 31 which is provided with a check valve 32, in order to bypass the resistance of the pressure reducing valve 28 during unlocking.

The actuator 8 provided for actuating the securing element 7 is, on the one hand, connected to the unlocking pressure port 16 via a pressure switching valve 19, wherein the pressure switching valve 19 is formed such that at the pressure provided for unlocking the locking element 11 the corresponding pressure chamber 8*e* of the actuator 8 is shut off from the remaining pressure circuit, i.e. the pressure switching valve 19 will only open at a pressure p2, which lies above the normal unlocking pressure for unlocking the locking element 11. To be able to adjust the various pressure levels for actuating the locking element 11 on the one hand and for actuating the securing element 7 on the other hand, the valve means 18 comprises a corresponding pressure control means 20 which according to the illustrated embodiment of FIG. 4 can comprise a pressure reducing valve 21 and a directional or switching valve or secondary switching valve 22 provided upstream of this pressure reducing valve 21. The pressure reducing valve 21 and the secondary switching valve 22 provided upstream of the same advantageously are provided upstream of the above-described primary switching valve 23, so that pressure coming from the pressure source P initially is applied to the secondary switching valve 22 and then to the pressure reducing valve 21, before the pressure reduced by the pressure reducing valve 21 then is applied to the primary switching valve 23.

At the switching position of the secondary switching valve 22 as shown in FIG. 4, the input pressure p2 coming from the pressure source P is connected through to the pressure reducing valve 21, in order to be reduced there and then be used by the primary switching valve 23 either for unlocking or locking the locking element 11. The pressure p3 reduced by the pressure reducing valve 21 is smaller than the switching pressure of the pressure switching valve 19, so that the securing element 7 remains shut off from the pressure circuit 15 or its pressurized portion. However, when the secondary switching valve 22 is moved into its other switching position, the pressure reducing valve 21 is bypassed and the full input pressure p2 is applied to the unlocking pressure port 16 from the pressure source P. The pressure switching valve 19 is formed and/or adjusted such that the switching pressure is smaller than the input pressure p2, so that in this case the pressure switching valve 19 opens and the pressure is applied to the securing element 7 and/or its actuator 8, whereby the coupling receptacle 6 is unlocked.

For locking the coupling receptacle 6 the actuator 8, in particular a locking chamber 8*v* of the actuator 8, is on the other hand hydraulically connectable to the locking pressure port 17 and/or the unlocking pressure port 16 bypassing the switching valve 19, so that independently of the aforementioned increased pressure level pressure from the pressure circuit 15 can be applied to the locking chamber 8*v* of the actuator 8. The connection of the locking chamber 8*v* advantageously is effected via an alternating check valve and/or a shuttle valve 50 which may be adapted to be a bidirectional check valve. As shown in FIG. 4, the alternating check valve 50 can on the input side be connected with the locking pressure port 17 on the one hand and with the unlocking pressure port 16 on the other hand, and can on the output side be connected with the locking chamber 8*v* of the actuator 8. A shut-off and/or check valve body can be movable back and forth between the connecting lines 51 and 52 on the input side, so as to shut off the respective pressure port in which currently lower pressure is present. If, for example, the higher pressure is at the locking pressure port 17, the alternating check valve 50 shuts off the connection to the unlocking pressure port 16. If, vice versa, the higher pressure is at the unlocking pressure port 16, the alternating check valve 50 shuts off the connection to the locking pressure port 17.

Such alternating non-return function prevents an inadvertent back flow of pressure fluid into the respective pressureless switched unlocking or locking lines 16 or 17. At the same time it is ensured by means of the alternating check valve 50 that when pressure is present either at the pressure port 16 or at the pressure port 17, the pressure is applied to the locking chamber 8*v* of the actuator 8. If there are pressures at both pressure ports 16 and 17, the respective higher pressure is applied to the locking chamber 8*v*.

The actuator 8 is thus adapted to be of the double-acting type and comprises two pressure chambers acting in opposite directions, namely the locking chamber 8*v* and the unlocking chamber 8*e* connected with the pressure switch valve 19. Advantageously, the locking pressure chamber 8*v* is, in terms of its effective cross-section, i.e. its acting cross-sectional area, adapted to be smaller than the unlocking chamber 8*e* in order to achieve that an unlocking actuation is effected in case equal pressures are present in both chambers, which is subsequently described in more detail with reference to FIG. 5.

Figure 5:
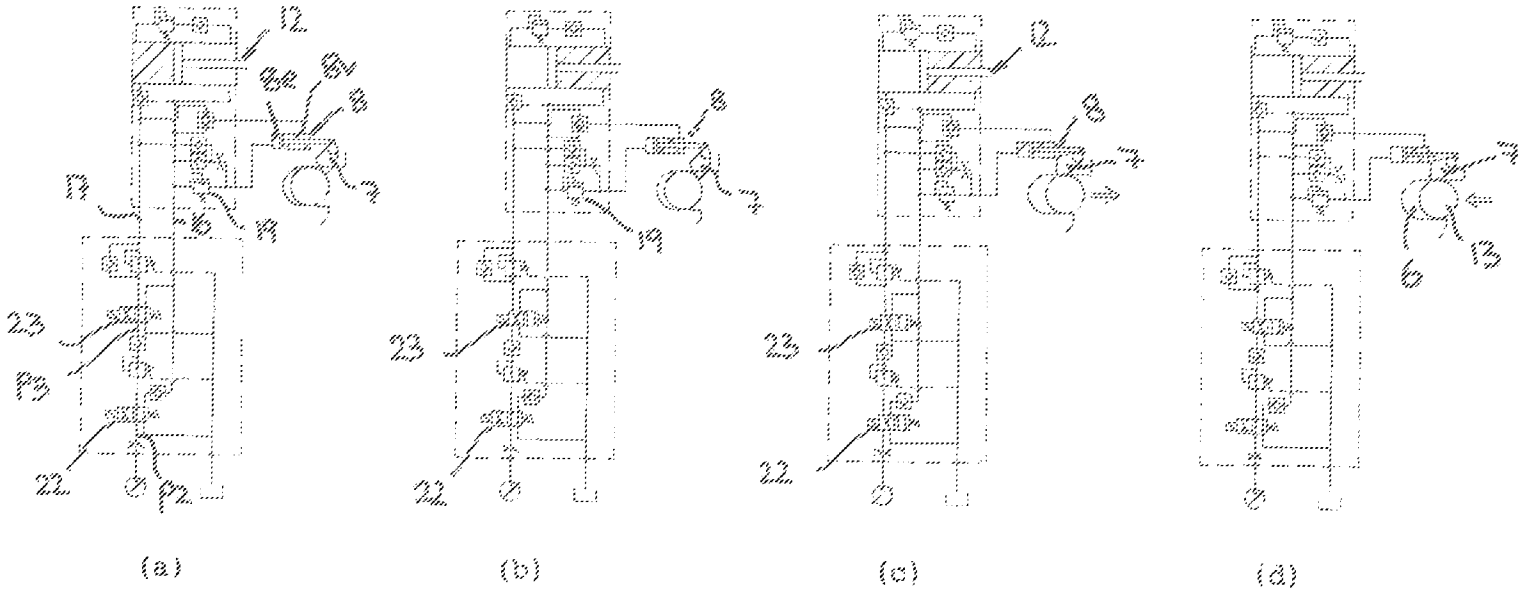
FIG. 5 shows the pressure circuit of FIG. 4 in different switching states when coupling and decoupling a tool.

If, in the coupled, locked operating position according to FIG. 5(*a*), hydraulic pressure is applied to the locking pressure port 17 from the pressure circuit 15 in the intended manner, such pressure gets into the locking chamber of actuator 12 on the one hand so as to securely hold the locking element 11 in its locked position. On the other hand, the pressure from the locking pressure port 17 gets into the locking chamber 8*v* of the actuator 8 via the connecting line 51 and the alternating check valve 50, the actuator 8 thus being securely held in its locking position by the securing element 7. The unlocking chamber 8*e* of the actuator 8 is shut off from the pressure of the pressure circuit 15 by means of the pressure switch valve 19 and/or is not even pressurized from the pressure circuit 15 in the first place, since the pressure switch valve 19 is only connected with the unlocking pressure port 16.

If the tool is to be decoupled, the pressure of the pressure circuit 15 is applied to the unlocking pressure port 16 by switching the primary switching valve 23 so that the actuator 12 of the main lock is pressurized in the opposite manner so as to release the locking element 11. The pressure provided at the unlocking pressure port 16 is simultaneously again applied to the locking chamber 8*e* of the actuator 8 so that the securing element 7 at the first locking axle 13 still remains locked at first. The pressure is thereby applied to the locking chamber 8*v* via line 52 and the alternating check valve 50. In doing so, the alternating check valve 50 switches in order to prevent inadvertent back flow into the pressureless switched locking pressure line 17.

On the other hand, the pressure switch valve 19 does not yet switch and/or does not yet open, since the normal unlocking pressure, i.e. the unlocking pressure p3 at the unlocking pressure port 16, which pressure is reduced by the pressure reducing valve 21, still lies below the threshold pressure of the pressure switch valve 19 which accordingly does not yet open so that the unlocking pressure chamber 8*e* of the actuator 8 is still switched pressureless, cf. FIG. 5(*b*).

In order to open and/or release also the securing element 7 at the first locking axle 13 upon opening the main locking element 11 at the second locking axle 14, the pressure at the unlocking pressure port 16 is increased by switching the secondary switching valve 22, cf. FIG. 5(*c*), thereby providing the full input pressure p2 of the pressure circuit 15 at the unlocking pressure port 16. The pressure reducing valve 21 is in this connection bypassed, cf. FIG. 5(*c*).

Such increased unlocking pressure p2 at the unlocking pressure port 16 on the one hand provides for opening of the pressure switch valve 19 and applying the pressure p2 to the unlocking chamber 8*e* of the actuator 8. On the other hand, the increased unlocking pressure p3 is still present in the locking pressure chamber 8*v* of the actuator 8 via the alternating check valve 50 so that the two chambers 8*v* and

8*e* so to speak work against each other. However, since the cross-sectional area of the unlocking chamber 8*e* is greater than the cross-sectional area of the locking chamber 8*v* in the above described manner, the actuator 8 carries out an actuation, more particularly an actuation towards the unlocking position, cf. FIG. 5(*c*).

If the tool is completely decoupled and a new tool is to be coupled, the pressure switching circuit 15 is in principle again in the unlocking position according to FIG. 5(*b*), i.e. the secondary switching valve 22 is switched back so that the pressure is applied to the primary switching valve 23 via the pressure reducing valve 21 which primary switching valve 23 applies the pressure p3 to the unlocking pressure port 16. On the one hand, this leads to unlocking the actuator 12 and/or the locking element 11 connected thereto. On the other hand, the reduced unlocking pressure p3 is applied from the unlocking pressure port 16 to the locking chamber 8*v* of the actuator 8 via the alternating check valve 50 so that the securing element 7 has in principle moved into its locking position and/or is biased towards it. The first locking element and/or the first locking axle 13 moving into the coupling receptacle 6 can, however, push back the securing element 7 against the hydraulic pretensioning provided by locking chamber 8*v*, cf. FIG. 5(*d*). Due to the hydraulic pretensioning the securing element 7 snaps back as soon as the locking axle 13 has completely retracted, which considerably facilitates the coupling operation.

In the alternative it would, however, also be possible during the coupling operation to first actively open the securing element 7 by means of increased pressure at the pressure reducing valve 16, and to lock by switching the pressure only after the axle 13 has completely retracted.

As shown in FIG. 4, a check valve 24 is provided in the main control block of the valve means 18, which check valve is provided between the secondary switching valve 22 and the unlocking pressure port 16 in the bypass line around the pressure reducing valve 21. Upon actuation of the primary switching valve 23 for unlocking the locking receptacle 10, this check valve 24 prevents an unwanted pressure loss via the still unactuated secondary switching valve 22 towards the tank T.

A further check valve 40 is provided in the other connecting line between the secondary switching valve 22 and the primary switching valve 23, in order to prevent that at the switching condition for unlocking the securing element 7, i.e. for actuating the actuator 8, the pressure applied to the unlocking pressure port 16 inadvertently flows back via the primary switching valve 23 then open towards the tank. At this configuration, the full system pressure p2 is applied to the unlocking pressure port 16 via the then switched switching valve 22 past the pressure reducing valve 21, while on the other hand the primary switching valve 23 is switched into the unlocking position, so that the fully connected system pressure p2 might flow backwards so to speak via the primary switching valve 23 and the pressure reducing valve 21 to the tank, which however is prevented by the check valve 40. The check valve 40 can be provided upstream or also downstream of the pressure reducing valve 21 between the two switching valves 23 and 22.

As is furthermore shown in FIG. 4, further check valves 25 and 26 are provided in relief lines which by bypassing the aforementioned pressure switching valve 19 connect the unlocking chamber 8*e* of the actuator 8 of the securing element 7 with the unlocking pressure port 16 and the locking pressure port 17 and hence with the tank depending on the switching position of the main valve block, in order to provide for a back flow of the fluid pressed into the unlocking chamber 8*e* of the actuator 8. As shown in FIG. 4, the relief lines 33 and 34 each are equipped with a check valve 25 and 26, which check valves only allow a back flow of hydraulic fluid, but no pressurization of the actuator 8 from the pressurized pressure ports.

In principle, instead of the two relief lines 33 and 34 only one such relief line might be provided, in order to provide for a back flow of the fluid pressed into the actuator 8. The use of two such relief lines 33 and 34 together with the check valves 25 and 26 provided therein, in particular with a parallel arrangement of the two check valves, however increases the safety against an unwanted opening of the securing element 7 in the case of a defect of one of the two check valves 25 and 26. Should one of the check valves 25 or 26 have a malfunction and let fluid pressure through in direction of the actuator 8 of the securing element 7, this pressure always will be decreased immediately via the second check valve, since the respective other line, to which the other, second check valve is connected, i.e. the line or the port 16 or 17, necessarily is connected with the tank T. When pressure is applied to the one check valve from one of the ports 16 or 17, the respective other port 17 or 16 is pressureless and connected with the tank, so that the parallel arrangement of two check valves as shown in FIG. 4 on the back flow side of the actuator 8 significantly increases the safety against maloperation of the same.

To prevent the pressure fluid from flowing back too fast via the relief lines 33 and 34, in particular when the pressure switching valve 19 is open, the relief lines 33 and 34 are provided with a flow impeder 27 in the form of an orifice plate, cf. FIG. 4.

The relief line 33 leading to the locking line provides for the relief of the hydraulic pressure in the unlocking chamber 8*e* of the actuator 8 of the securing element 7, as soon as the secondary switching valve 22 again is brought into the starting position and hence the safety means of the coupling receptacle 6 again is to be activated, i.e. is to be hydraulically relocked via the locking chamber 8*v*. Locking up of the pressure at this point, i.e. in the region of the actuator 8, thereby is prevented, as soon as the pressure switching valve 19 again closes due to the pressure in the unlocking line decreasing below the switching pressure. In addition, in this case the switching pressure always initially still exists in the unlocking line and/or the unlocking pressure port 16, so that a relief in this way would not be possible even without closing the pressure switching valve 19. In this case, however, the pressure can be decreased towards tank T via the locking pressure port 17 and the still actuated primary switching valve 23.

The other relief line 34, which extends from the orifice plate to the unlocking line or to the unlocking pressure port 16, provides for a decrease in pressure when the primary switching valve 23 is again brought into the starting position shown in FIG. 4 simultaneously or very shortly after the secondary switching valve 22, for example by maloperation or power failure, against its intended normal operation. The pressure at the actuator 8 of the securing element 7 then can be decreased towards the tank T via the then open unlocking line and/or the still open unlocking pressure port 16 as well as the primary switching valve, cf. FIG. 4.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A quick coupler comprising a coupling receptacle for receiving a first locking part and a locking receptacle for receiving a second locking part, wherein to the coupling receptacle a securing element is associated for at least one of catching and securing the first locking part in the coupling receptacle, and to the locking receptacle a locking element is associated for locking the second locking part in the locking receptacle, wherein the locking element and the securing element are actuatable by a common pressure circuit that includes an unlocking pressure port and a locking pressure port, wherein the securing element is actuable by a double-acting, reversible actuator and is hydraulically movable into an opening position as well as into a locking position by means of applying pressure medium from the common pressure circuit, wherein at least a locking chamber and an unlocking chamber of the actuator are pressurizable via a valve arrangement in dependency of a pressure level at at least one of the unlocking and locking pressure ports of the common pressure circuit;

wherein the locking and unlocking pressure ports are selectively connectable with at least one of a pressure source and a return line via valve means, wherein a pressure switching valve of the valve arrangement opens upon at least one of reaching and exceeding a predetermined first pressure and is connected with the unlocking pressure port, and the valve means of the pressure circuit includes pressure control means for selectively controlling the pressure applied at the unlocking pressure port to a second pressure greater than the first pressure, and to a third pressure smaller than the first pressure; and wherein the pressure control means includes a pressure reducing valve for reducing the second pressure to the third pressure and a secondary switching valve provided upstream of the pressure reducing valve, which secondary switching valve in a first switching position applies an input pressure to the pressure reducing valve and in a second switching position applies the input pressure bypassing the pressure reducing valve to the unlocking pressure port.

2. The quick coupler of claim 1, wherein the locking and unlocking chambers of the actuator are adapted to be acting in opposite directions.

3. The quick coupler of claim 1, wherein a cross-sectional area of the locking chamber is smaller than a cross-sectional area of the unlocking chamber.

4. The quick coupler of claim 1, wherein the valve arrangement is adapted such that pressure from the pressure circuit is substantially permanently applied to at least one of the locking and unlocking chambers of the actuator.

5. The quick coupler of claim 1, wherein at least one of the locking and unlocking chambers of the actuator are connected to the unlocking pressure port and the locking pressure port via a shuttle valve such that the respective pressure port to which lower pressure is applied is locked, and the respective pressure port to which higher pressure is applied is connected to the locking chamber.

6. The quick coupler of claim 1, wherein the securing element is adapted to be purely hydraulically actuable.

7. The quick coupler of claim 1, wherein the securing element is adapted to be free from mechanical pretensioning and spring devices.

8. The quick coupler of claim 1, wherein the valve arrangement is adapted such that in dependency of the pressure level at at least one of the unlocking and the locking pressure ports, at least one pressure chamber is selectively pressurizable.

9. The quick coupler of claim 1, wherein the valve means downstream of the pressure reducing valve includes a primary switching valve, which primary switching valve in a first switching position passes the pressure reduced by the pressure reducing valve to the locking pressure port and in a second switching position passes the pressure reduced by the pressure reducing valve to the unlocking pressure port.

10. The quick coupler of claim 9, wherein the valve arrangement is adapted such that at a first pressure level at the unlocking pressure port only the locking chamber of the actuator is pressurized while the unlocking chamber of the actuator is kept at least substantially pressure-free, and at a second pressure level greater than the first pressure level, at least one unlocking chamber and at least one locking chamber of the actuator are pressurized.

11. A quick coupler comprising a coupling receptacle for receiving a first locking part and a locking receptacle for receiving a second locking part, wherein to the coupling receptacle a securing element is associated for at least one of catching and securing the first locking part in the coupling receptacle, and to the locking receptacle a locking element is associated for locking the second locking part in the locking receptacle, wherein the locking element and the securing element are actuatable by a common pressure circuit that includes an unlocking pressure port and a locking pressure port, wherein the securing element is actuable by a double-acting, reversible actuator and is hydraulically movable into an opening position as well as into a locking position by means of applying pressure medium from the common pressure circuit, wherein at least a locking chamber and an unlocking chamber of the actuator are pressurizable via a valve arrangement in dependency of a pressure level at at least one of the unlocking and locking pressure ports of the common pressure circuit;

wherein the valve arrangement is adapted such that in dependency of the pressure level at at least one of the unlocking and the locking pressure ports, at least one pressure chamber is selectively pressurizable; and wherein at a first pressure level only the locking chamber and at a second pressure level at least one locking chamber and at least one unlocking chamber of the actuator are pressurizable.

12. The quick coupler of claim 11, wherein the locking and unlocking pressure ports are selectively connectable with at least one of a pressure source and a return line via valve means, wherein a pressure switching valve of the valve arrangement opens upon at least one of reaching and exceeding a predetermined first pressure and is connected with the unlocking pressure port, and the valve means of the pressure circuit includes pressure control means for selectively controlling the pressure applied at the unlocking pressure port to a second pressure greater than the first pressure, and to a third pressure smaller than the first pressure.

13. The quick coupler of claim 11, wherein the locking and unlocking chambers of the actuator are adapted to be acting in opposite directions.

14. The quick coupler of claim 11, wherein a cross-sectional area of the locking chamber is smaller than a cross-sectional area of the unlocking chamber.

15. The quick coupler of claim 11, wherein the valve arrangement is adapted such that pressure from the pressure circuit is substantially permanently applied to at least one of the locking and unlocking chambers of the actuator.

16. The quick coupler of claim 11, wherein at least one of the locking and unlocking chambers of the actuator are connected to the unlocking pressure port and the locking pressure port via a shuttle valve such that the respective pressure port to which lower pressure is applied is locked, and the respective pressure port to which higher pressure is applied is connected to the locking chamber.

17. The quick coupler of claim 11, wherein the securing element is adapted to be purely hydraulically actuable.

18. The quick coupler of claim 11, wherein the securing element is adapted to be free from mechanical pretensioning and spring devices.

19. The quick coupler of claim 11, wherein the valve arrangement is adapted such that in dependency of the pressure level at at least one of the unlocking and the locking pressure ports, at least one pressure chamber is selectively pressurizable.

20. The quick coupler of claim 11, wherein the valve means downstream of the pressure reducing valve includes a primary switching valve, which primary switching valve in a first switching position passes the pressure reduced by the pressure reducing valve to the locking pressure port and in a second switching position passes the pressure reduced by the pressure reducing valve to the unlocking pressure port.

21. The quick coupler of claim 20, wherein the valve arrangement is adapted such that at a first pressure level at the unlocking pressure port only the locking chamber of the actuator is pressurized while the unlocking chamber of the actuator is kept at least substantially pressure-free, and at a second pressure level greater than the first pressure level, at least one unlocking chamber and at least one locking chamber of the actuator are pressurized.

22. A coupling assembly comprising:

a first coupling member comprising:
- a coupling receptacle;
- a locking receptacle;
- a securing element;
- a locking element; and
- a double-acting, reversible actuator comprising a first chamber and a second chamber, the double-acting, reversible actuator having an opening position and a locking position;

a second coupling member comprising:
- a first locking part; and
- a second locking part;

a common pressure circuit comprising:
- pressure medium;
- an unlocking pressure port;
- a locking pressure port;
- a first valve arrangement; and
- a second valve arrangement;

wherein the coupling receptacle of the first coupling member dimensioned to receive the first locking part of the second coupling member, and wherein the securing element of the first coupling member dimensioned to at least one of catch and secure the first locking part in the coupling receptacle;

wherein the locking receptacle of the first coupling member dimensioned to receive the second locking part of the second coupling member, and wherein the locking element of the first coupling member dimensioned to lock the second locking part in the locking receptacle;

wherein the securing element and the locking element of the first coupling member are actuatable by the common pressure circuit;

wherein the securing element is actuable by the double-acting, reversible actuator and is movable into the opening position and the locking position by the pressure medium of the common pressure circuit;

wherein the first and second pressure chambers of the double-acting, reversible actuator are pressurizable via the first and second valve arrangements in dependency of a pressure level at at least one of the unlocking and locking pressure ports of the common pressure circuit.

23. The coupling assembly of claim 22, wherein the valve arrangements are adapted such that in dependency of the pressure level at at least one of the unlocking and locking pressure ports of the pressure circuit such that the first chamber is at a first pressure level and the second chamber is at a second pressure level;

wherein the valve arrangements are adapted such that at a first pressure level at the unlocking pressure port, only one of either the first and the second chambers of the double-acting, reversible actuator is pressurized while the other of the first and the second locking chamber is substantially pressure-free;

wherein at a second pressure level higher than the first pressure level, the unlocking, first, and second chambers are pressurized;

wherein the first chamber and the second chamber of the double-acting, reversible actuator are adapted to be acting in opposite directions;

wherein the first chamber and the second chamber of the double-acting, reversible actuator have cross-sectional areas of different size;

wherein the valve arrangements are adapted such that pressure from the pressure circuit is substantially permanently applied to at least one of the first chamber and the second chamber of the double-acting, reversible actuator;

wherein at least one of the first chamber and the second chamber of the double-acting, reversible actuator is connected to the unlocking pressure port and the locking pressure port via a shuttle valve such that the respective pressure port to which lower pressure is applied is locked;

wherein the locking and unlocking pressure ports are selectively connectable with at least one of a pressure source and a return line via a valve means of the pressure circuit, wherein a pressure switching valve of the valve arrangements opens upon at least one of reaching and exceeding a predetermined first pressure control means pressure and is connected with the unlocking pressure port, and the valve means of the pressure circuit includes a pressure control means for selectively controlling the pressure applied at the unlocking pressure port to a second pressure control means pressure greater than the first pressure control means pressure, and to a third pressure control means pressure smaller than the first pressure control means pressure;

wherein the pressure control means includes a pressure reducing valve for reducing the pressure control means pressure to the third pressure control means pressure and a secondary switching valve provided upstream of the pressure reducing valve, which secondary switching valve in a first switching position applies an input pressure to the pressure reducing valve and in a second switching position applies the input pressure bypassing the pressure reducing valve to the unlocking pressure port; and wherein the valve means downstream of the pressure reducing valve includes a primary switching valve, which primary switching valve in a first switching position passes the third pressure control means pressure reduced by the pressure reducing valve to the locking pressure port, and in a second switching position passes the pressure reduced by the pressure reducing valve to the unlocking pressure port.

24. A coupling assembly comprising:

a first coupling member comprising a securing element and a double-acting, reversible actuator comprising a first chamber and a second chamber, the double-acting, reversible actuator having an opening position and a locking position;

a second coupling member comprising a first locking part and a second locking part; and a pressure circuit comprising pressure medium, an unlocking pressure port, a locking pressure port, a first valve arrangement, and a second valve arrangement;

wherein the securing element is actuable by the double-acting, reversible actuator and is movable into the opening position and the locking position by the pressure medium of the pressure circuit;

wherein the first and second pressure chambers of the double-acting, reversible actuator are pressurizable via the first and second valve arrangements in dependency of a pressure level at at least one of the unlocking and locking pressure ports of the pressure circuit;

wherein the first coupling member further comprises a coupling receptacle, a locking receptacle, and a locking element;

wherein the coupling receptacle of the first coupling member dimensioned to receive the first locking part of the second coupling member, and wherein the securing element of the first coupling member dimensioned to at least one of catch and secure the first locking part in the coupling receptacle;

wherein the locking receptacle of the first coupling member dimensioned to receive the second locking part of the second coupling member, and wherein the locking element of the first coupling member dimensioned to lock the second locking part in the locking receptacle; and wherein the securing element and the locking element of the first coupling member are actuatable by the pressure circuit.

25. The coupling assembly of claim 24, wherein the valve arrangements are adapted such that in dependency of the pressure level at at least one of the unlocking and locking pressure ports of the pressure circuit such that the first chamber is at a first pressure level and the second chamber is at a second pressure level.

26. The coupling assembly of claim 24, wherein the valve arrangements are adapted such that at a first pressure level at the unlocking pressure port, only one of either the first and the second chambers of the double-acting, reversible actuator is pressurized while the other of the first and the second locking chamber is substantially pressure-free; and wherein at a second pressure level higher than the first pressure level, the unlocking, first, and second chambers are pressurized.

27. The coupling assembly of claim 24, wherein the first chamber and the second chamber of the double-acting, reversible actuator are adapted to be acting in opposite directions.

28. The coupling assembly of claim 24, wherein the first chamber and the second chamber of the double-acting, reversible actuator have cross-sectional areas of different size.

29. The coupling assembly of claim 24, wherein the valve arrangements are adapted such that pressure from the pressure circuit is substantially permanently applied to at least one of the first chamber and the second chamber of the double-acting, reversible actuator.

30. The coupling assembly of claim 24, wherein at least one of the first chamber and the second chamber of the double-acting, reversible actuator is connected to the unlocking pressure port and the locking pressure port.

* * * * *